US005590879A

United States Patent [19]

Tripp

[11] Patent Number: 5,590,879

[45] Date of Patent: Jan. 7, 1997

[54] METHOD AND APPARATUS FOR AUTOMATIC RANDOM SELECTION IDENTIFICATION

[76] Inventor: Warren W. Tripp, 2070 Driscoll Dr., Reno, Nev. 89509

[21] Appl. No.: 489,606

[22] Filed: Jun. 12, 1995

[51] Int. Cl.[6] ..... A63F 3/06

[52] U.S. Cl. ..... 273/144 R; 273/144 B

[58] Field of Search ..... 273/144 R, 144 A, 273/144 B

[56] References Cited

U.S. PATENT DOCUMENTS 3,300,217 1/1967 Franklin ..... 273/144 A X
3,468,542 9/1969 Ernst ..... 273/144 R
4,877,246 10/1989 Kropkowski ..... 273/144 R
4,961,578 10/1990 Chateau ..... 273/144 R
5,121,920 6/1992 Laezzo et al. ..... 273/144 B

*Primary Examiner*—William H. Grieb
*Attorney, Agent, or Firm*—Herbert C. Schulze

[57] ABSTRACT

A method and apparatus for random determination and display of a multiplicity of numbers from a larger quantity of numbers including the placing of numbers on balls, mixing the balls in an air chamber, selecting one ball at a time, placing the balls as selected in pockets on a timing wheel, confirming the selection and placement of the balls electronically, recording the numbers by video camera, and displaying the numbers on a display board as selected.

6 Claims, 4 Drawing Sheets

FIG. 1
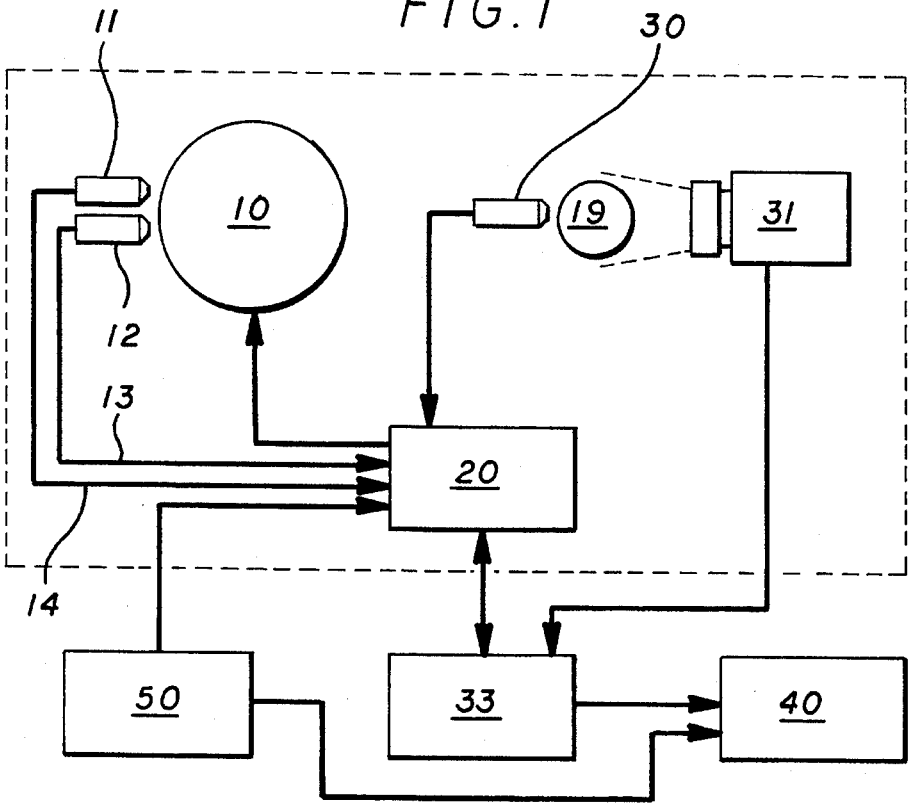
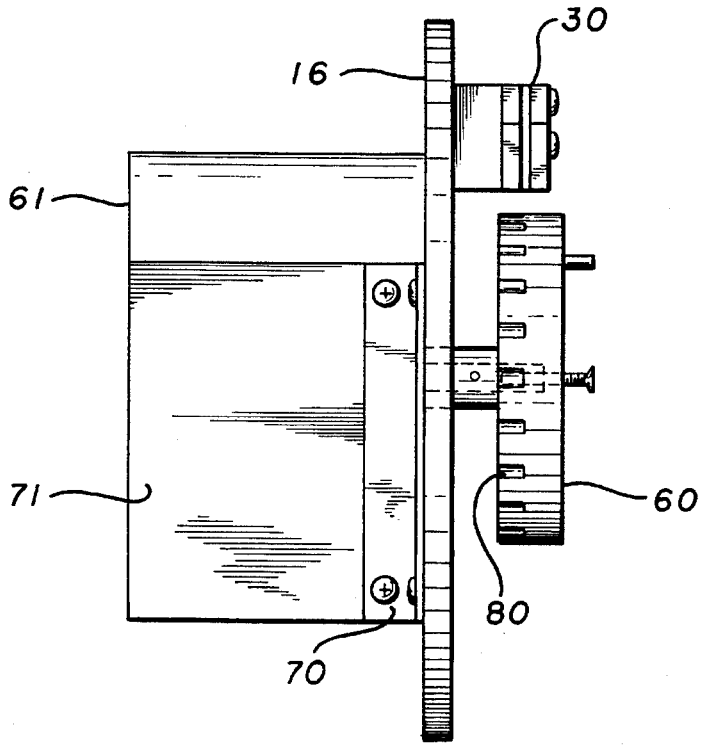
FIG. 5

FIG.2B
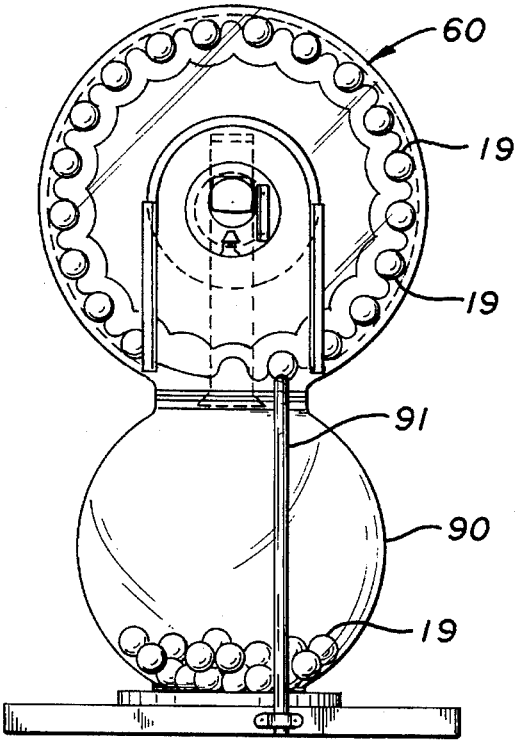
FIG.2D
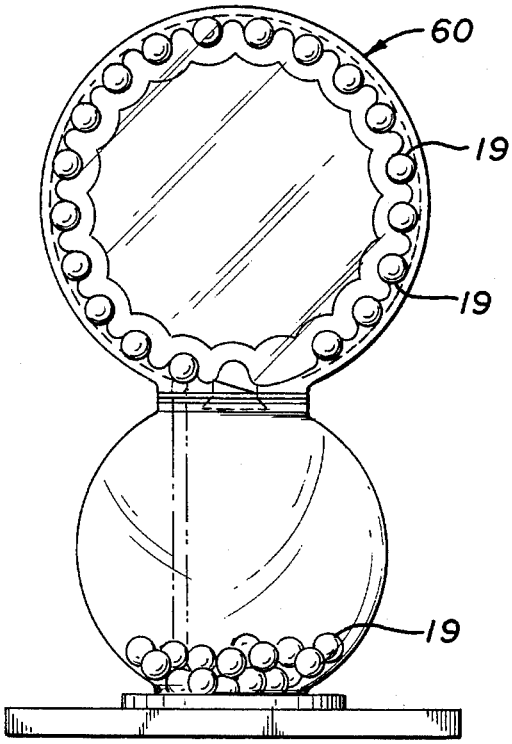
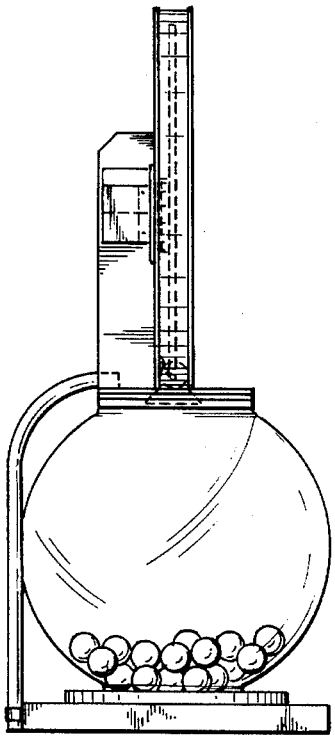
FIG.2c
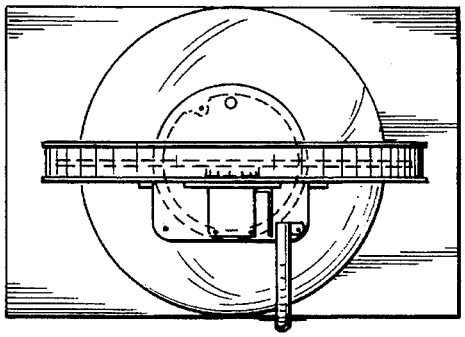
FIG.2A

METHOD AND APPARATUS FOR AUTOMATIC RANDOM SELECTION IDENTIFICATION

CROSS REFERENCE TO RELATED PATENT APPLICATIONS

There are no patent application filed by me related to the within application.

BACKGROUND OF THE INVENTION

I. Field of the Invention

This invention is in the general field of random selection of numbers, or other items;

The invention is more particularly in the field of random selection through a mixing and selection of elements in a chamber;

The invention is even more particularly directed to a new and unique method and apparatus for selecting, and displaying each item as selected;

The invention is most particularly directed to a method and apparatus for identifying balls, or the like, mixed in an air chamber, individually selected, identified through an electronic identifier, and individually displayed after selection.

II. Description of the Prior Art

In lotteries, keno games, and the like, it is known to mix balls (much like table tennis balls) carrying numbers, or the like, in an air chamber, with gusts of air keeping the balls in a constantly changing arrangement with relation to each other. The balls are then individually selected, by various types of selection arrangements such as tubes receiving one ball at a time, suction devices to pick individual balls, and the like. After selection, the balls are identified by the operator and the results are posted. In some cases attempts have been made to read the balls by a bar code or some other system. To date none of these have been thoroughly satisfactory.

The present invention is unique in utilizing a timing wheel with sockets for receiving balls and a video viewer to view the balls as detected, with means to automatically, or manually, display the results on a display board.

I know of no prior art utilizing the afore described new system.

SUMMARY OF THE INVENTION

There are many games, lotteries, and other situations in which a certain quantity of numbers or other items are selected from a larger quantity for determination of prizes, statistical work, and other purposes. A common method of selecting such items is to mix the items in a tumbling air chamber, with periodic selection of individual items by having them drop into a tube, or utilizing some other method of selecting the individual items.

Generally, such selection devices are less than fully effective in that the balls are not necessarily picked truly at random, and the results are not necessarily accurately, nor automatically, displayed.

I have now conceived and developed a unique and greatly improved method and apparatus for such random selection and display.

I accomplish this by a timing wheel located adjacent an air tumbling chamber, wherein the wheel has a number of pockets, or sockets on its periphery such that it stops until it receives on ball in a socket and then advances to the next position to receive the next ball, and so on until the desired number of balls has been collected.

Concurrent with the collection of the balls, a ball detector confirms, through a central processing unit, that the ball is in position on the wheel. At the same time, a video camera views the ball and sends a picture to a vision system computer which is coordinated with the data from the central processing unit.

The results (the selected balls) are then sequentially displayed on a display board (known to those skilled in the art). Alternately, the results may be manually displayed by an operator at a console which displays on a display board.

It is an object of this invention to provide a reliable random selection and display method and apparatus;

It is a further object of this invention to provide such a method and apparatus wherein there is no possibility of any deviation from true random selection;

It is a further object of this invention to provide such a method and apparatus where the results may be displayed visually, accurately and automatically.

The foregoing and other objects and advantages of this invention will become apparent to those skilled in the art upon reading the description of a preferred embodiment which follows in conjunction with a review of the appended drawings.

BRIEF DESCRIPTION OF THE DRAWINGS

FIG. 1 is a block diagram illustrating the elements of this invention and sequence of operations of the method;

FIG. 2 is a series of schematic elevations of portions of an apparatus suitable to practice the method of this invention;

FIG. 5 is a schematic side elevation of elements of a device to practice the method of this invention.

DESCRIPTION OF A PREFERRED EMBODIMENT

Figure 3:
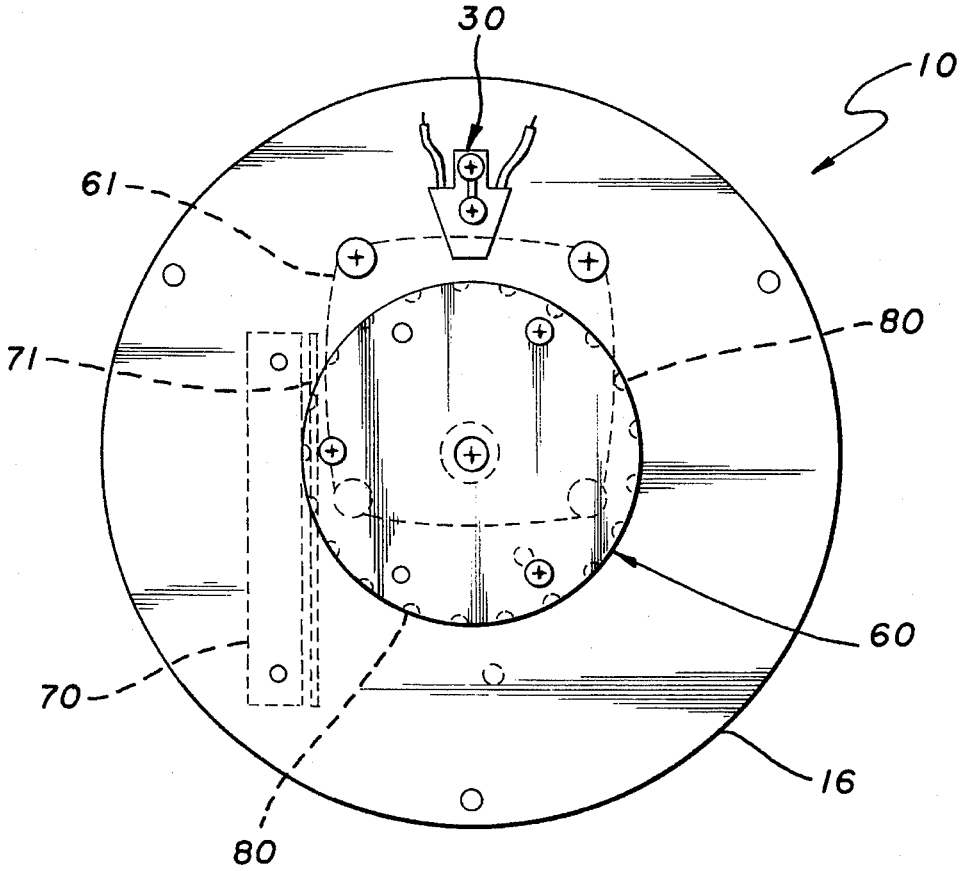
FIG. 3 is a schematic front elevation of elements of a device to practice the method of this invention.

FIG. 1 is a block diagram illustrating the operation, and the invention, in such a manner as will be understood by those skilled in the art. The additional figures are almost superfluous, but are felt to be consistent with a full disclosure.

In FIG. 1 the timing wheel and motor 10 are shown to be controlled by a CPU (central processing unit) 20, known to those skilled in the art, which determines the sequence of operations of the timing wheel, and thus the receipt of the items (balls or the like).

The ball "in position detector" 11, and the subsequent "position" detector 12 ensure the accuracy of the placement of the ball, or other item, on the timing wheel. All of this information is processed to the CPU through circuits 13 and 14.

At the same time, ball detector 30 transmits its signal of the verification of the ball (or other item) to the CPU.

Video camera, or the like, 31 and CPU 20 transmit their information to a vision system computer, or the like, 33, known to those skilled in the art. The information thus transmitted may be displayed on the results board 40.

Alternatively, the information will be processed through the Tripp Plastics 80 Key Console 50 (known to those skilled in the art) for manual display on the results board 40.

FIG. 2 has several views of the timing wheel and associated features. 2*a* is a top plan of a device suitable to practice this invention; 2B is a back side elevation thereof; 2C is a right side elevation thereof; not shown is the left side elevation thereof which is a mirror image of 2C; and 2D is a front elevation thereof. As shown, balls will be placed at random within the pockets of the timing wheel until all desired numbers of balls are in place. As each ball is placed, it will be recorded and revealed. Those skilled in the art will understand the working of this upon examining these drawings and the remainder of the drawings as commented upon below.

Figure 4:
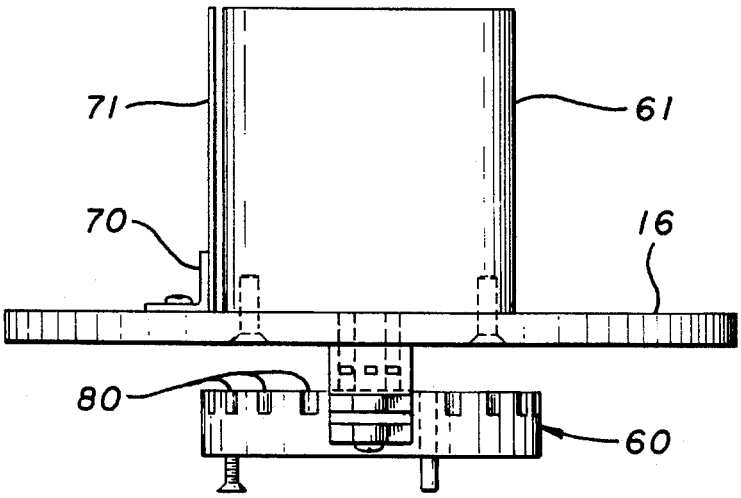
FIG. 4 is a schematic top elevation of the elements of a device to practice the method of this invention.

FIGS. 3, 4 and 5 show the timing wheel 60 mounted upon mounting plate 16, with the reflective sensor 30 in position to read the balls as they are carried by the timing wheel, which is powered by motor 61. Printed circuit board 71 with its microprocessor is mounted on mounting bracket 70. A plurality of ball receiving sockets 80 are shown.

Figure 6:
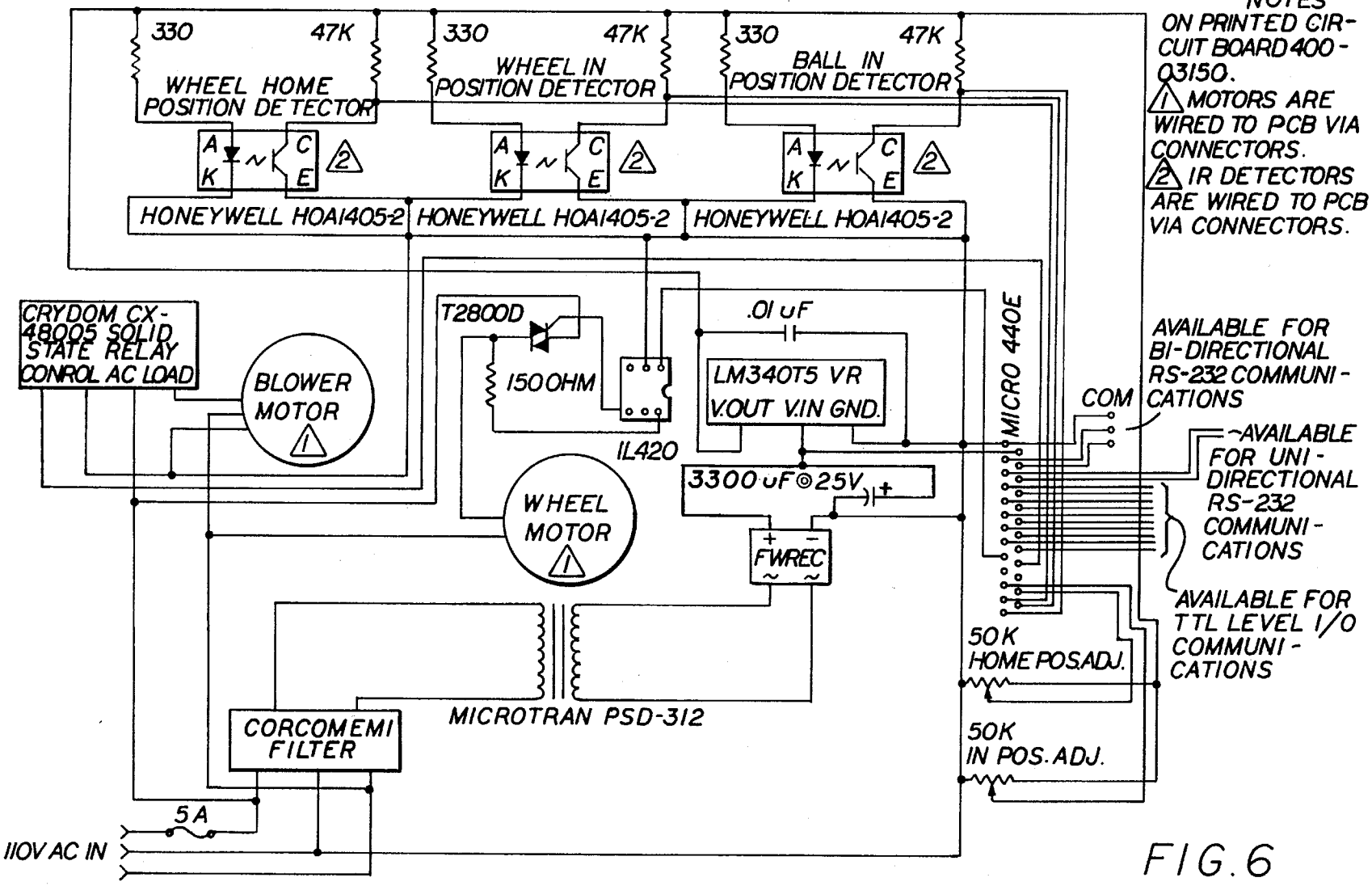
FIG. 6 is a schematic drawing of electrical circuitry.

FIG. 6 will be understood by those skilled in the art. FIG. 6 represents the electrical circuitry for the apparatus.

In operation, the balls 19 are agitated by an air blower within chamber 90. The timing wheel will stop until a ball is placed into a socket on the timing wheel by means of the ball selection means 91. When it is confirmed by the sensors that a ball is in the socket the timing wheel will move so as to place the next socket in position. The position of individual balls is detected by the position detectors 11 and 12, which will confirm the accurate positioning of the balls within the sockets on the timing wheel. Individual balls are received into sockets 80 on the timing wheel. The ball detector 30 detects the ball, and at the same time the ball is read by video camera 31. This process will continue until all sockets have been confirmed to be carrying balls.

As each ball is confirmed, the corresponding number of that ball will be displayed on the display board 40 either through a vision system computer 33, know to those skilled in the art, or through a Tripp Plastics 80 key console, known to those skilled in the art. Thus there will be an accurate display of the exact balls selected, as the balls are selected.

In an important alternative embodiment, The balls, or the like may carry an identifying chip, with or without an external visible marking. In this case, the sensors will include means (known to those skilled in the art) to sense the chip, and thus verify the information (a number, or the like) as to that particular ball, or the like. If the ball, or the like, does not carry a visible marking, the sensor can activate a monitor, or the like, to display the particular indicium carried by the particular ball, or the like, and display it on the display board.

While the embodiments of this invention shown and described are fully capable of achieving the objects and advantages desired, it is to be understood that such embodiments are shown for purposes of illustration only and not for purposes of limitation.

I claim:

1. The method of selecting and displaying certain indicium at random from a plurality of indicia comprising: placing indicium on a plurality of items; mixing the items and holding the items in suspension in a chamber by blowing air within the chamber; selecting items, one at a time, by an item selector means; placing each item, as selected, in a socket within a moving wheel carrying a plurality of sockets; detecting the accuracy of placement of each item within the appropriate socket by detection sensors; reading the indicium of each item as selected by an item detector; viewing the indicium of each item; and displaying each indicium, on a display board as the indicium is selected.

2. The method of claim 1 wherein the display of the indicia is controlled by electronic means activating the display of the indicia by video means.

3. The method of claim 1 wherein the display of the indicia is controlled by an operator using a console connected to the display.

4. The method of claim 1 wherein the items are balls.

5. The method of claim 1 wherein the indica are numbers.

6. Apparatus for selecting and displaying certain indicium at random from a plurality of indicia including: a plurality of indicium carrying items; a chamber for mixing the items; air blower means associated with said chamber; an item selection wheel cooperative with said chamber; means to intermittently move and stop said item selection wheel; means to deposit one item on said wheel at each stop position; sensor means to detect the indicium as each item is deposited on said wheel; and means to display the indicium of each item as detected.

* * * * *